US005775271A

United States Patent [19]

Compagnucci

[11] Patent Number: 5,775,271

[45] Date of Patent: Jul. 7, 1998

[54] ENGINE WITH ELECTRIC IGNITION FOR MODEL CARS HAVING FORCED AIR COOLING SYSTEM

[75] Inventor: Rossano Compagnucci, Osimo (AN), Italy

[73] Assignee: Compagnucci-S.P.A., Italy

[21] Appl. No.: 759,746

[22] Filed: Dec. 3, 1996

[30] Foreign Application Priority Data

Dec. 5, 1995 [IT] Italy ..... MC95 U 000029

[51] Int. Cl.[6] ..... F01P 7/04

[52] U.S. Cl. ..... 123/41.65; 123/149 C; 123/617; 123/DIG. 3

[58] Field of Search ..... 123/41.56, 41.65, 123/41.69, 617, 149 C, DIG. 3

[56] References Cited

U.S. PATENT DOCUMENTS 4,744,432 5/1988 Shibata et al. ..... 123/41.65
5,152,256 10/1992 Yamauchi et al. ..... 123/41.57

FOREIGN PATENT DOCUMENTS 1050117 2/1959 Germany ..... 123/41.65

*Primary Examiner*—Noah P. Kamen
*Attorney, Agent, or Firm*—Leonard Bloom

[57] ABSTRACT

This invention concerns an engine with electric ignition for model cars. A cooling fan is installed in front of the finned cylinder which is supported in a case. The fan is driven by a toothed belt.

3 Claims, 1 Drawing Sheet

ENGINE WITH ELECTRIC IGNITION FOR MODEL CARS HAVING FORCED AIR COOLING SYSTEM

BACKGROUND OF THE INVENTION

This patent application concerns an engine with electric ignition for model cars having forced air cooling.

The engine in question is designed to improve the performance of small internal-combustion engines used on model cars. Currently model car engines also known as micro-engines are all air cooled but not with forced ventilation; this means that to date the cylinder of these engines has been cooled via heat dispersion by means of conventional external finning which is invested by the air flow produced by the model car as it is propelled forward.

To date, the requirement of constantly cooling the engine has meant that the finned cylinder in the engines was installed outside the coachwork, namely in a position where the outdoor air flow would invest it directly.

Even if the advantages of a forced air cooling system were well known in the sector, up to now no model car manufacturer had mounted engines with this type of cooling because of the technical problems involved due substantially to the small housing space available on board the model cars.

In view of the precarious cooling systems which have always characterised current micro-engines, it has never been possible to use commercial petrol and the same in fact have an incandescence spark plug requiring an extremely expensive mixture of alcohol as fuel, whose combustion temperature is lower than that of commercial petrol.

SUMMARY OF THE INVENTION

The scope of this invention is to design a micro-engine which runs on commercial petrol; for this purpose it has been necessary to equip this new micro-engine with a forced air cooling system as well as an ignition system and spark plug. Thanks to the above forced air cooling system, the engine according to the invention no longer needs to be mounted outside the model car in order to expose it to the outdoor air flow; for the first time it is now possible to house the engine inside the coachwork of the model car or in any other closed space, even for a different purpose to model car propulsion. A particular feature of the invention, and at the same time its greatest advantage, consists of having mounted a small cooling fan opposite the finned cylinder of the model car engine while leaving the other overall dimensions and structure of the engine itself unaltered.

The fan is in fact sustained by a support that also acts as air conveyor and is rotated by a toothed belt engaging a geared pulley directly splined on the drive shaft.

In addition said geared pulley is also used, in order to make the engine as compact as possible, to support the magnet, which, by passing through each rotation in front of a Hall sensor, activates a capacitive control unit supplied by a 4.8 volt battery which strikes off the spark of the spark plug and ignites the engine.

It is important to note that a special support fork is used for the Hall sensor with a fixing system especially designed to fix the fork to the engine block.

In particular the fork is position astride over the hub of said engine block and is fixed with screws to a collar outside the engine block, coaxially to the hub.

For major clarity the description of the invention continues with reference to the enclosed drawing which is intended for purposes of illustration and not in a limiting sense whereby:

DESCRIPTION OF THE PREFERRED EMBODIMENT

Figure 1:
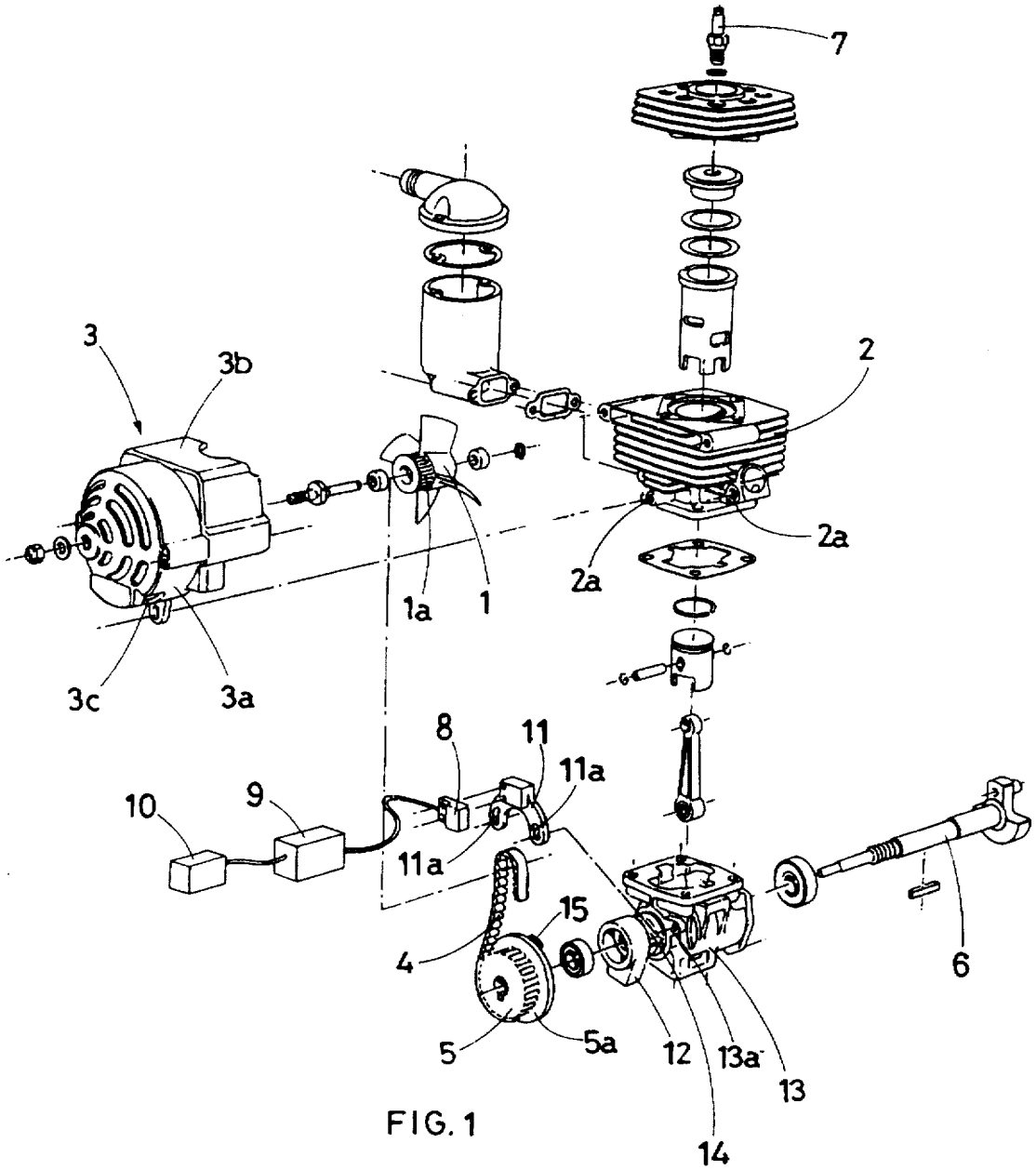
FIG. 1 is an axonometric exploded view of the micro-engine according to the invention.

With reference to the above drawing, the engine is characterised by a forced air cooling system consisting of an axial fan (1) with horizontal axis positioned in front of the finned cylinder (2) and supported in a case (3).

The case (3) consists in fact of a circular bottom cover (3*a*), having a grid as air intake, and connected to a shaped mouthpiece (3*b*) which conveys the airflow generated by the fan (1) against the fins of the cylinder (2).

The case (3) is also fixed to the cylinder (2) by means of a set of three screws engaging in the blind holes (2*a*) on the base and sides of the cylinder (2) body.

The fan (1) hub being provided with a toothed collar (1*a*) with which a geared belt (4) engages, and which also engages a geared pulley (5) splined on the drive shaft (6).

In particular said geared belt (4) passes into the cover (3*a*)—in which the fan (1) is in operating position—through the notch (3*c*) on the bottom wall of the cover (3*a*).

The above pulley (5) is provided with a flange (5*a*) on the back of which the magnet is supported, the same being designed to activate, at each revolution of the pulley, the capacitive ignition system of the spark plug (7).

Each passage of the magnet is detected by a Hall sensor (8) which activates the capacitive control unit (9) that is supplied by a 4.8 volt battery (10) and ignites the spark plug (7).

To support the Hall sensor (8), a semi-circular fork (11) is provided, placed astride over the hub (12) of the engine block (13) abutting and screwed to a collar (14) on the engine block (13) itself.

In particular, said fork (11) is provided on its two arms with respective curved slots (11*a*) for the screws which are fixed to the engine block (13) that is in turn provided with blind threaded holes (13*a*); the use of the slots (11*a*) being designed to vary the fixing angle of the fork (11) with respect to the engine block (13) in order to regulate the lead angle of the ignition moment of the spark plug (7).

Even if this description refers to the new micro-engine in question with reference to model cars, the same may also be used on model planes or boats or other purposes.

What is claimed is:

1. An engine with electric ignition for model cars characterized by an axial fan (1) having a horizontal axis positioned in front of a finned cylinder (2) and having a hub, the fan being supported in a case (3) and provided, on its hub, with a toothed collar (1*a*) with which it engages a geared belt (4) as well as a geared pulley (5) splined on a drive shaft (6) and which acts as support for a magnet designed to excite a Hall sensor (8) connected to a capacitive control unit (9) that ignites a spark plug (7), the case (3) which houses and supports the fan (1), having a circular bottom cover (3*a*) provided with a grid as an air inlet and having a shaped mouthpiece (3*b*) which conveys the air flow generated by fan (1) against the fins of the cylinder (2).

2. An engine with electric ignition for model cars characterized by an axial fan (1) having a horizontal axis positioned in front of a finned cylinder (2) and having a hub, the fan being supported in a case (3) and provided, on its hub, with a toothed collar (1*a*) with which it engages a geared belt (4) as well as a geared pulley (5) splined on a drive shaft (6) and which acts as support for a magnet designed to excite a Hall sensor (8) connected to a capacitive control unit (9) that ignites a spark plug (7), wherein the case (3) is fixed to cylinder (2) by means of screws engaging into corresponding blind holes (2*a*) on the body of cylinder (2).

3. An engine with electric ignition for model cars characterized by an axial fan (1) having a horizontal axis positioned in front of a finned cylinder (2), and having a hub, the fan being supported in a case (3) and provided, on its hub, with a toothed collar (1*a*) with which it engages a geared belt (4) as well as a geared pulley (5) splined on a drive shaft (6) and which acts as support for a magnet designed to excite a Hall sensor (8) connected to a capacitive control unit (9) that ignites a spark plug (7), wherein the Hall sensor (8) is supported in front of the pulley (5) which supports the magnet, by means of a semi-circular fork (11) positioned astride the hub (12) of the engine block (13) provided with a collar (14) againist which said fork (11) abuts and is fixed by means of two screws fitting into curved slots (11*a*), realized on the arms of fork (11).

* * * * *